US009435526B2

(12) United States Patent
Goelz et al.

(10) Patent No.: US 9,435,526 B2
(45) Date of Patent: Sep. 6, 2016

(54) LED LIGHTING APPARATUS WITH FACILITATED HEAT TRANSFER AND FLUID SEAL

(71) Applicant: Cree, Inc., Durham, NC (US)

(72) Inventors: David P. Goelz, Milwaukee, WI (US); Craig Raleigh, Racine, WI (US); Don Miletich, Franklin, WI (US); Kurt S. Wilcox, Libertyville, IL (US)

(73) Assignee: Cree, Inc., Durham, NC (US)

( * ) Notice: Subject to any disclaimer, the term of this patent is extended or adjusted under 35 U.S.C. 154(b) by 460 days.

(21) Appl. No.: 13/833,006

(22) Filed: Mar. 15, 2013

(65) Prior Publication Data

US 2014/0177226 A1 Jun. 26, 2014

Related U.S. Application Data

(60) Provisional application No. 61/745,552, filed on Dec. 22, 2012, provisional application No. 61/746,862, filed on Dec. 28, 2012.

(51) Int. Cl.

| | |
|---|---|
| ***F21V 1/00*** | (2006.01) |
| ***F21V 29/00*** | (2015.01) |
| ***F21V 31/00*** | (2006.01) |
| ***F21V 19/00*** | (2006.01) |
| ***F21V 29/70*** | (2015.01) |
| *F21W 131/103* | (2006.01) |

(52) U.S. Cl.

CPC ..... *F21V 29/22* (2013.01); *F21V 19/0055* (2013.01); *F21V 29/2212* (2013.01); *F21V 29/70* (2015.01); *F21V 31/005* (2013.01); *F21W 2131/103* (2013.01)

(58) Field of Classification Search

CPC ..... F21V 29/70; F21Y 2103/003; F21Y 2105/001

USPC ..... 362/294, 218, 244, 237

See application file for complete search history.

(56) References Cited

U.S. PATENT DOCUMENTS

| | | | | |
|---|---|---|---|---|
| 6,461,010 | B1 | 10/2002 | Knight et al. | |
| 7,607,799 | B2 * | 10/2009 | Ohkawa | 362/237 |
| D681,250 | S | 4/2013 | Ruffalo et al. | |
| 2008/0043466 | A1 * | 2/2008 | Chakmakjian et al. | 362/237 |

(Continued)

FOREIGN PATENT DOCUMENTS

| | | |
|---|---|---|
| DE | 199 22 176 | 11/2000 |
| WO | 2006049086 | 5/2006 |

(Continued)

*Primary Examiner* — Sean Gramling

(74) *Attorney, Agent, or Firm* — Jansson Munger McKinley & Kirby Ltd.

(57) ABSTRACT

LED lighting apparatus including (a) a circuit board which has a plurality of light sources spaced thereon, (b) a heat sink to which the circuit board is thermally coupled, and (c) a securement structure which includes a rigid peripheral structure applying force along a peripheral area of the circuit board toward the heat sink to increase the thermal coupling therebetween to facilitate heat transfer from the light sources during operation. The lighting apparatus may also include an optical member with a plurality of lens portions over corresponding light sources and a peripheral region, the securement structure engaging the peripheral region which sandwiches a gasket against the heat sink. The apparatus may use manipulation involving surface convexity, such as bowing, thereby allowing the securement structure to further facilitate surface-to-surface thermal coupling between the circuit board and the heat sink.

24 Claims, 7 Drawing Sheets

(56) References Cited

U.S. PATENT DOCUMENTS

| | | | | |
|---|---|---|---|---|
| 2008/0237840 | A1 | 10/2008 | Alcoe et al. | |
| 2009/0296403 | A1 | 12/2009 | Zhang et al. | |
| 2010/0328947 | A1 | 12/2010 | Chang et al. | |
| 2011/0038154 | A1* | 2/2011 | Chakravarty | F21V 29/004 362/249.02 |
| 2011/0043120 | A1 | 2/2011 | Panagotacos et al. | |
| 2011/0103051 | A1* | 5/2011 | Wilcox | F21S 2/005 362/235 |
| 2011/0103059 | A1* | 5/2011 | Chen et al. | 362/249.02 |
| 2011/0222284 | A1 | 9/2011 | Kong et al. | |
| 2012/0120659 | A1 | 5/2012 | Lopez et al. | |
| 2012/0268936 | A1 | 10/2012 | Pickard et al. | |
| 2012/0287634 | A1* | 11/2012 | Kochetkov | 362/244 |

FOREIGN PATENT DOCUMENTS

| | | | |
|---|---|---|---|
| WO | 2011053349 | | 5/2011 |
| WO | 2013152286 | A1 | 10/2013 |

* cited by examiner

LED LIGHTING APPARATUS WITH FACILITATED HEAT TRANSFER AND FLUID SEAL

RELATED APPLICATION

This application claims the benefit of U.S. Provisional Application Ser. No. 61/745,552, filed Dec. 22, 2012 and U.S. Provisional Application Ser. No. 61/746,862, filed Dec. 28, 2012. The entirety of the contents of each of Application Ser. Nos. 61/745,552 and 61/746,862 are incorporated herein by reference.

FIELD OF THE INVENTION

This invention relates generally to the field of LED light fixtures and, more particularly, to the field of LED light fixtures for various high-luminance area lighting applications such as roadway lighting, factory lighting, parking lot lighting, commercial building lighting, and the like.

BACKGROUND OF THE INVENTION

In recent years, the use of light-emitting diodes (LEDs) in development of light fixtures for various common lighting purposes has increased, and this trend has accelerated as advances have been made in the field. Indeed, lighting applications which previously had typically been served by fixtures using what are known as high-intensity discharge (HID) lamps are now being served by LED light fixtures. Such lighting applications include, among a good many others, roadway lighting, factory lighting, parking lot lighting, and commercial building lighting.

In many of such products, achieving high levels of illumination over large areas with specific light-distribution requirements is particularly important. And in such situations it is desirable to minimize the use of large complex reflectors and/or varying orientations of multiple light sources to achieve desired illumination patterns.

Lighting fixtures using LEDs as light sources for various applications present particularly challenging problems. Heat dissipation is one particular problem. To ensure LED longevity and excellent long-term light-output performance, it is important that heat transfer away from the LEDs be facilitated in order to minimize thermal damage which may occur to LEDs during operation. Another problem, particularly when fixture mounting locations vary, is keeping LEDs protected from water, especially in outdoor locations. Dealing with these sorts of performance-related problems may sometimes be particularly difficult and involve various subtleties. In the present invention, long and involved trial-and-error development efforts led to performance breakthroughs.

In short, there is a significant need in the lighting industry for improved lighting fixtures using LEDs—fixtures that address problems associated with heat dissipation and appropriate protection of LEDs and which are adaptable for a wide variety of mountings and situations. Furthermore, there is a need for an improved LED-based lighting fixtures with high light-output performance and that are easy and cost-effective to manufacture.

SUMMARY OF THE INVENTION

The present invention is improved lighting apparatus including a circuit board having a plurality of light sources spaced thereon. The light sources may be solid-state light sources such as light emitting diodes (LEDs). The circuit board includes a circuit-board middle area and a circuit-board peripheral area and has a thermal-engagement surface opposite the light sources. The lighting apparatus also includes a heat sink having a surface for receiving the circuit board. A securement structure secures the circuit board to the heat sink. The securement structure includes a rigid peripheral structure applying force along the circuit-board peripheral area toward the heat sink to increase thermal contact across the facing area of the thermal-engagement surface of the circuit board and the surface of the heat sink.

This arrangement facilitates removal of heat from the light sources during operation by increasing surface-to-surface contact between the thermal-engagement surface of the circuit board and the surface of the heat sink. This facilitates excellent, substantially uniform thermal communication from the circuit board to the heat sink, thereby increasing heat transfer from the LEDs to the heat sink during operation.

In some embodiments, the rigid peripheral structure is a one-piece frame. The rigid peripheral structure may have a pressing portion with a substantially planar pressing surface and a stiffening portion which maintains planarity of the pressing surface.

In certain embodiments, prior to securement at least one of the thermal-engagement surface of the circuit board and the heat sink surface has a convexity. In some of such embodiments, the convexity is two-dimensional, such as bowing. In some other embodiments, the convexity is three-dimensional.

In some of these embodiments, the thermal-engagement surface of the circuit board has the convexity such that, prior to securement, distances between the thermal-engagement surface of the circuit board and the surface of the heat sink are greater along the circuit-board peripheral area than along the circuit-board middle area. In such embodiments, securement reduces the convexity. In some of such embodiments, the thermal-engagement surface of the heat sink is substantially flat.

In alternative embodiments, the surface of the heat sink has the convexity such that (a) prior to securement, distances between the thermal-engagement surface and the heat-sink surface are greater along the circuit-board peripheral area than along the circuit-board middle area. In such embodiments, securement conforms the thermal-engagement surface of the circuit board to the convexity.

The lighting apparatus may also include an optical member over the circuit board. The optical member has a lens region and a peripheral region. The lens region includes a plurality of lens portions each over corresponding light sources. The optical member is one-piece of a substantially rigid material such as acrylic. The securement structure engages the peripheral region of the optical member which sandwiches the circuit board against the heat-sink surface. The rigid peripheral structure of the securement structure provides substantially even pressure on the one-piece optical member which in turn presses the circuit board substantially uniformly against the heat sink. This facilitates heat transfer from the LEDs to the heat sink during operation.

In some embodiments, the optical member has a circuit-board-adjacent surface which, prior to securement, has a convexity that is reduced by securement. The convexity may be two-dimensional such as bowing. In some other embodiments, the convexity is three-dimensional.

The term "two dimensional," as used herein, means that a surface has two-dimensional convexity if lines along one coordinate direction of the surface are convex and lines along the perpendicular coordinate direction of the surface are straight. An example of forming a bowed (or two-dimensionally convex) surface is the simple bending of a flat sheet in one direction to form an elongate raised surface. The term "three-dimensional," as used herein means that a surface has three-dimensional convexity if along any direction, lines along the surface are convex. An example of a three-dimensional convex surface is a segment of a ball.

In some embodiments, particularly where the heat sink is open to water/air flow, the peripheral region of the optical member extends beyond and encircles the perimeter of the circuit board. The peripheral region of the optical member sandwiches a gasket against the heat sink, thereby facilitating fluid-tight sealing of the circuit board.

The rigid peripheral structure of the securement structure may be over the peripheral region of the optical member.

In certain embodiments, the lens region of the optical member is free of engagement by the securement structure. This simplifies the structure of the lighting apparatus while (1) facilitating heat-transfer engagement of the circuit board with a heat sink as described below, (2) allowing appropriate sealing against moisture ingress and (3) permitting optical-member glow thereacross because the securement structure is located only at the peripheral region. In some embodiments, the rigid peripheral structure may be overmolded in the peripheral region of the optical member.

In certain embodiments, the rigid peripheral structure is a one-piece frame disposed along the peripheral region of the optical member. The one-piece frame may be a drawn sheet-metal piece. In some of such embodiments, the rigid peripheral structure has a pressing portion with a substantially planar pressing surface and a stiffening portion which maintains rigidity and planarity of the pressing surface.

In some of the embodiments with the rigid peripheral structure over the peripheral region of the optical member, the peripheral structure is pressed against the optical member by a set of fasteners. Each fastener includes a fastener head and a threaded shank which extends from the fastener head through the rigid peripheral structure and through the optical member into threaded engagement with the heat sink.

In some embodiments, the heat sink includes a base which has the surface to which the circuit board is thermally coupled. In some of such embodiments, the heat sink includes a set of mounting posts each extending from the base through the peripheral region of the optical member to a distal post-end which is open to receive one of the fasteners. The distal post-ends are positioned, i.e., the posts are of a particular length, such that the posts limit compression of the rigid peripheral structure against the optical member caused by the fasteners.

The heat sink may include a surrounding structure around the optical member and configured such that the peripheral region of the optical member is recessed with respect to the surrounding structure. In certain of such embodiments, the stiffening portion of the rigid peripheral structure extends outwardly from the pressing portion of the peripheral structure and engages the surrounding structure of the heat sink.

The heat sink also has heat-transfer surfaces extending from the base in a first direction away from the circuit board, e.g., extending upwardly if the surface of the heat sink to which the circuit board is coupled faces downwardly. The heat-transfer surfaces of the heat sink may be surfaces of a plurality of fins extending away from the base in the first direction. In such embodiments, the surrounding structure may include a peripheral ridge extending from the base in a second direction opposite the first direction to provide additional heat-dissipating surface along the base. In some of such embodiments, at least a section of the peripheral ridge has an outward surface which is a continuation of a heat-transfer surface of one of the fins, such fin being a side fin along one side of the base.

In certain embodiments, the heat sink has a first positioning feature and the circuit board includes a second positioning feature. The first and second positioning features are configured and arranged for locating the circuit board along the heat sink. The optical member may include a third positioning feature in mating engagement with at least the second positioning feature of the circuit board to accurately align the optical member over the light sources.

In some of such embodiments, the first positioning feature is a cavity open at the heat-sink surface, and the second positioning feature is an aperture through the circuit board. In such embodiments, the third positioning feature may be a protrusion extending from the optical member, through the aperture of the circuit board, and into the cavity of the heat sink, thereby simultaneously locating the circuit board along the heat sink and accurately aligning the optical member over the light sources.

In some embodiments, the securement structure may include a set of screws each extending through the circuit-board middle area into threaded engagement with the heat sink, although the coupling between the circuit board and the heat sink may be free of screws. In embodiments free of screws, the circuit board may be positioned on the heat sink using first, second and third positioning features such as those described above.

In embodiments in which the circuit-board-adjacent surface of the optical member has convexity prior to securement, reduction (e.g., elimination) of such convexity by virtue of force applied on the peripheral region of the optical member by the rigid peripheral structure of the securement structure causes pressing of the middle area of the circuit board toward the heat sink with the first, second and third positioning members properly aligned. This further facilitates thermal coupling across the facing area of the circuit-board thermal-engagement surface and the heat-sink surface.

In descriptions of this invention, including in the claims below, the terms "comprising," "including" and "having" (each in their various forms) and the term "with" are each to be understood as being open-ended, rather than limiting, terms.

DETAILED DESCRIPTION OF EXEMPLARY EMBODIMENTS

FIGS. 1-6 illustrate lighting apparatus 10 according to the present invention which is incorporated in an LED light fixture 100.

Figure 1:
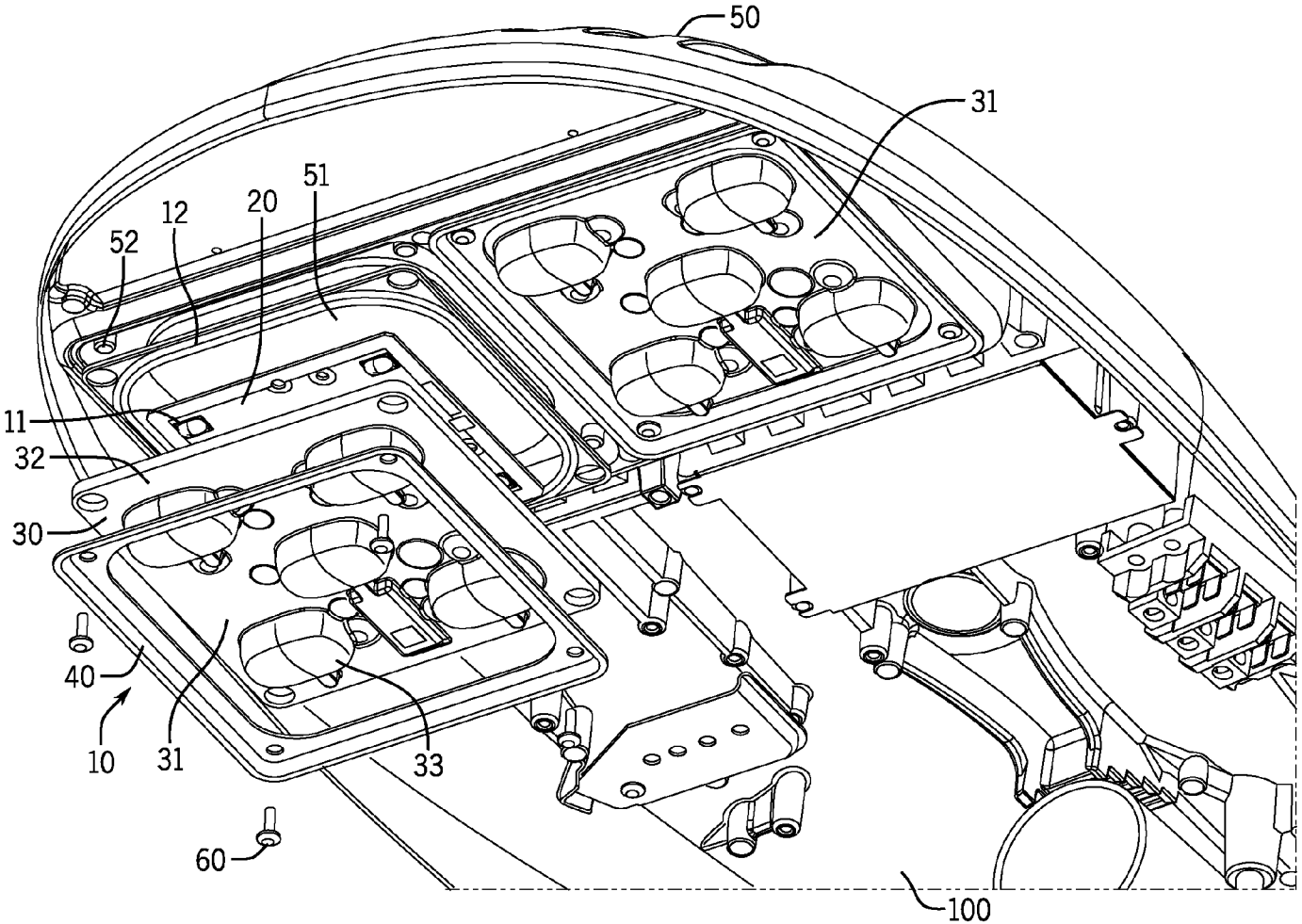
FIG. 1 is an exploded bottom perspective view of a fragment of an LED light fixture which incorporates a lighting apparatus of the present invention.
Figure 2:
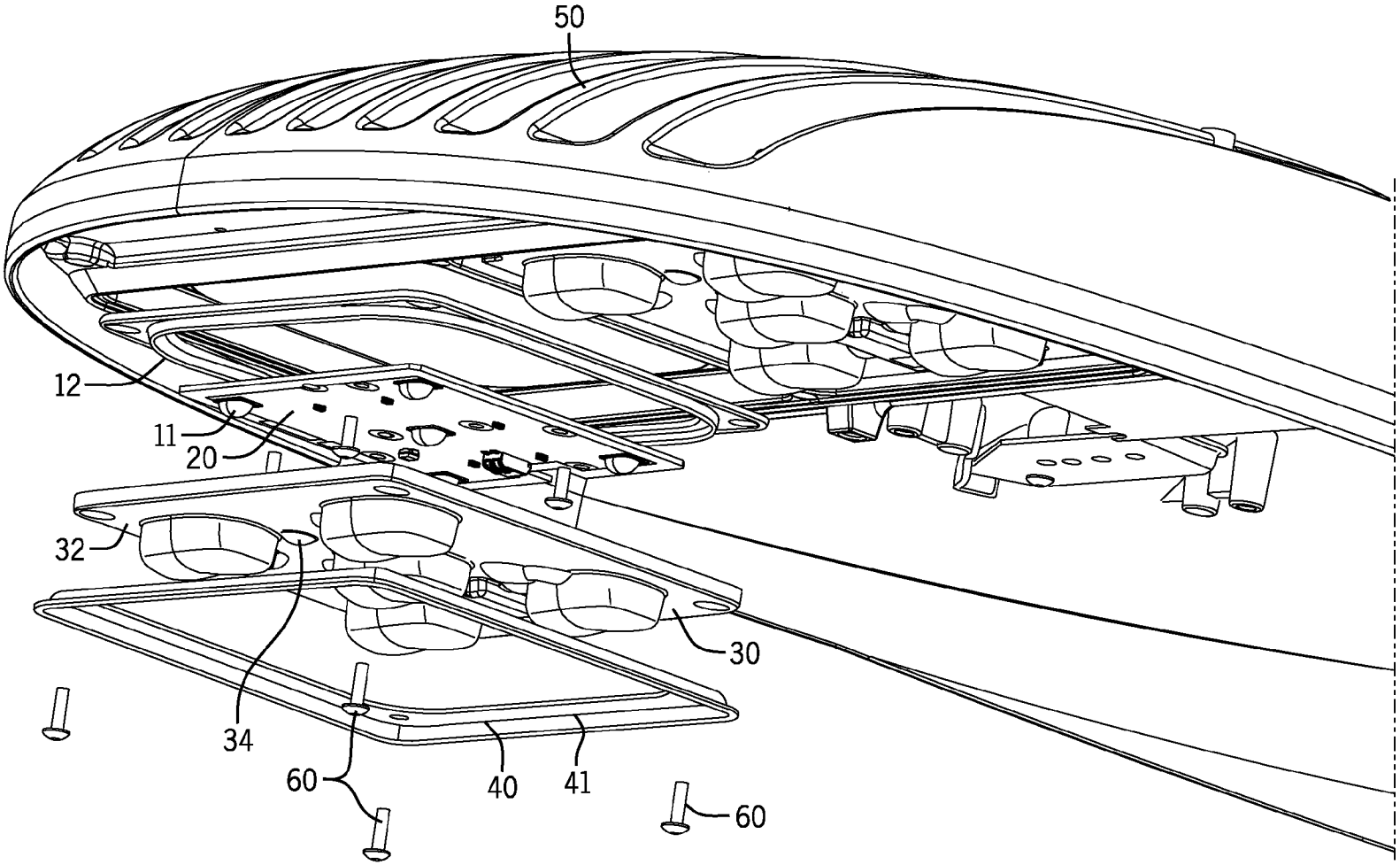
FIG. 2 is an exploded side perspective view of the fragment of the LED light fixture of FIG. 1.
Figure 3:
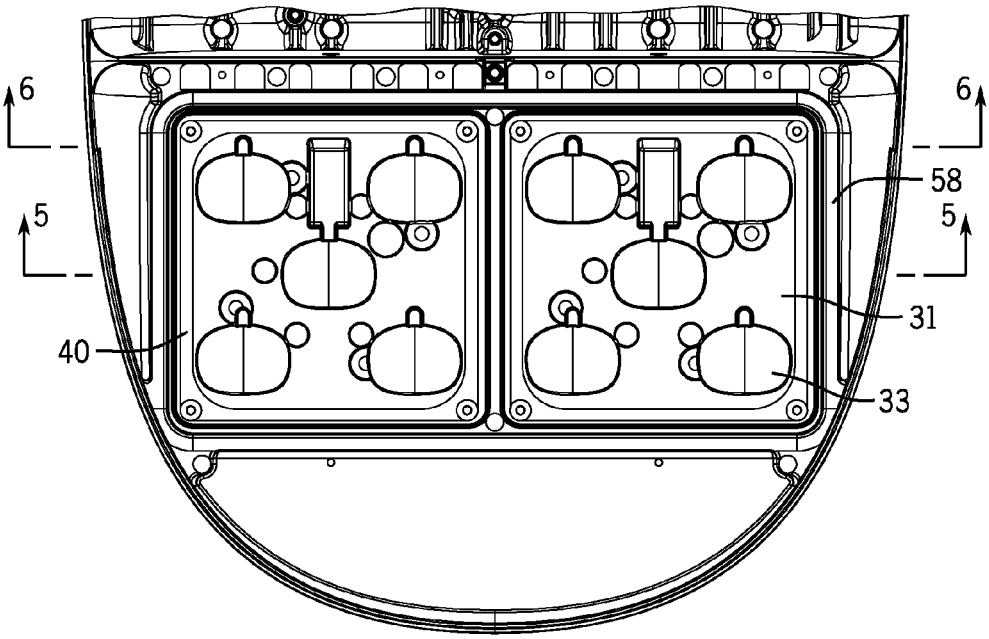
FIG. 3 is a bottom plan view of the fragment of the LED light fixture of FIG. 1.
Figure 4:
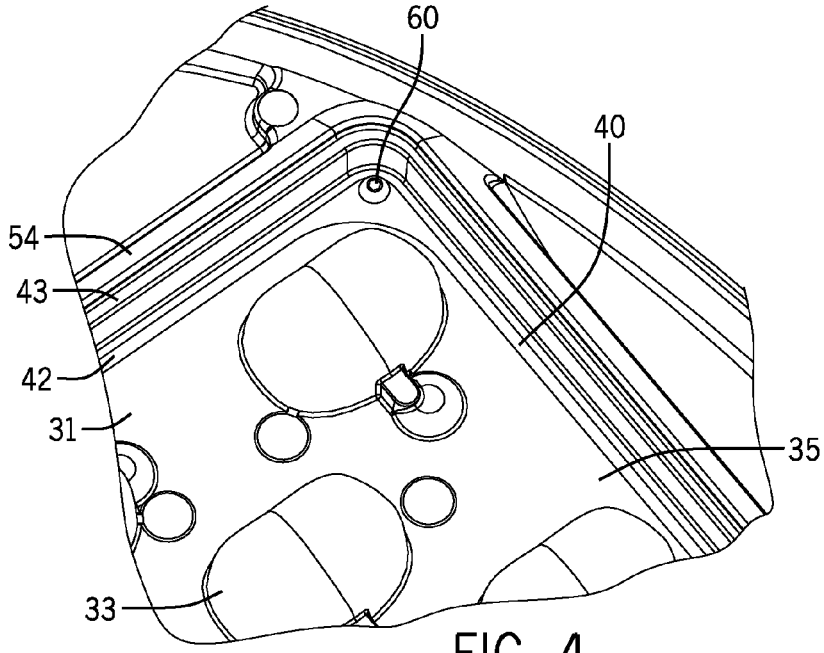
FIG. 4 is a fragmentary perspective view of the LED light fixture of FIG. 1.

FIGS. 1 and 2 best illustrate LED lighting apparatus 10 including a plurality of solid-state light sources 11 spaced on a circuit board 20 which includes a middle area 23 and a peripheral area 21. An optical member 30 is shown over circuit board 20 with a securement structure 40 configured to secure optical member 30 over light sources 11. Optical member 30 has a lens region 31 over light sources 11 and a perimetrical peripheral region 32 encircling lens region 31. FIGS. 3 and 4 best illustrate securement structure 40 configured to engage peripheral region 32 of optical member 30.

FIGS. 1-3 show lens region 31 of optical member 30 including a plurality of lens portions 33 each over a corresponding one of the light sources 11. FIGS. 1 and 2 show optical member 30 including a flange portion 34 extending over circuit board 20 and having an inner region 35 between lens portions 33 and peripheral region 32 encircling inner region 35. Flange portion 34 is shown to have surface shapes 341 which accommodate certain elements such as mounting and electrical connections protruding over the circuit board.

Figure 5:
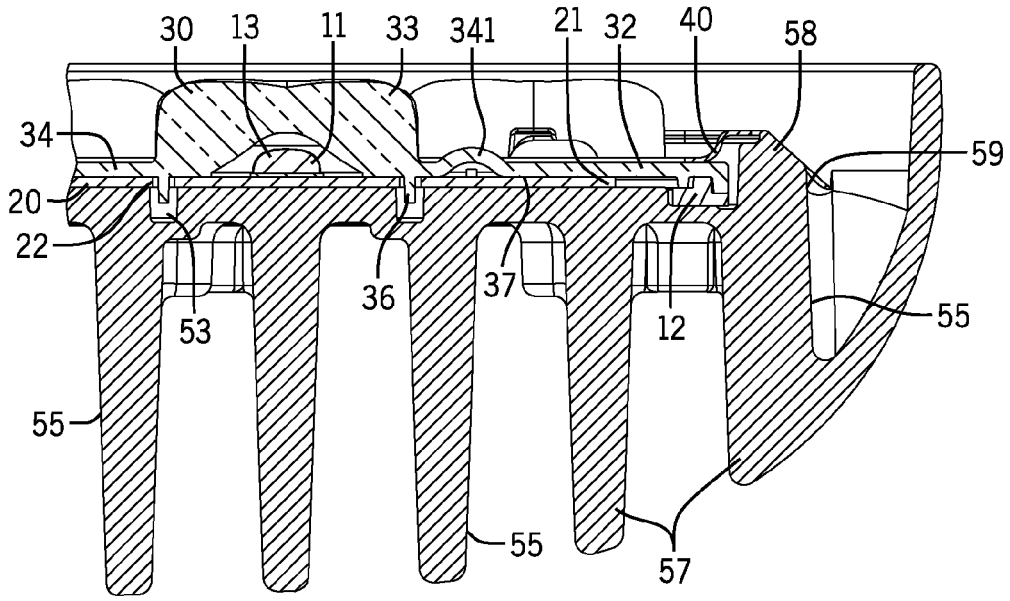
FIG. 5 is a fragmentary cross-sectional view of the LED light fixture of FIG. 1 taken along lines 5-5 seen in FIG. 3.

FIG. 5 shows optical member 30 including alignment features 36 for aligning optical member 30 over light sources 11 as described in more detail below. FIGS. 3-5 show securement structure 40 engaging peripheral region 32, with inner region 35 being free of engagement by securement structure 40. Securement structure 40 includes a rigid peripheral structure 41 pressing optical member 30 against circuit board 20.

Figure 13:
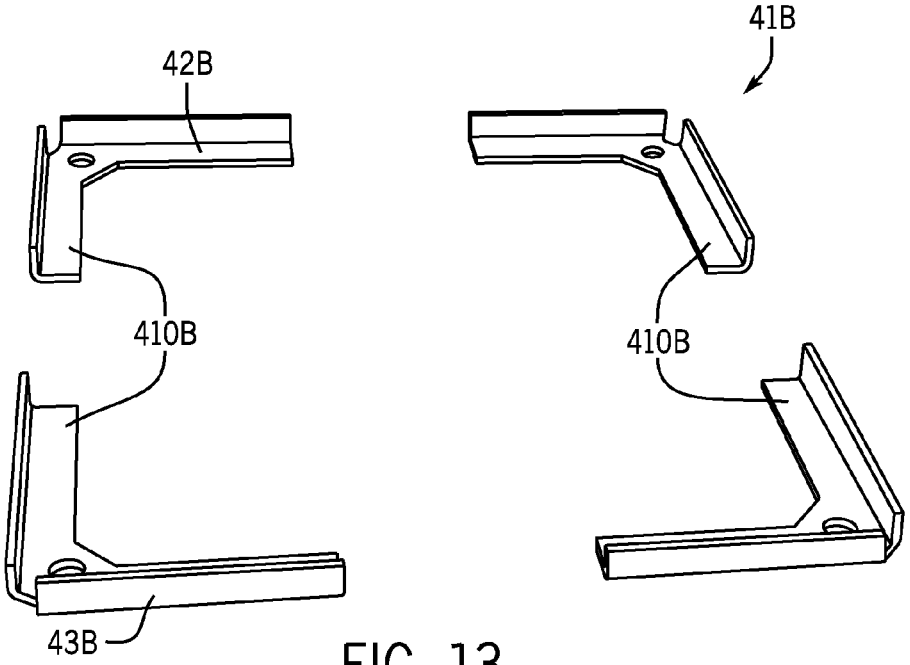
FIG. 13 is a perspective view of an alternative embodiment of the rigid peripheral structure which includes a plurality of separate pieces.

FIGS. 1-3 and 14 show rigid peripheral structure 41 and 41A as a one-piece frame which is a drawn sheet-metal piece. FIG. 13 shows rigid peripheral structure 41B which has four separate pieces 410B each configured for positioning over corners of either circuit board 20 or optical member 30.

FIGS. 1 and 2 also show optical member 30 as a one-piece member with lens portions 33 and flange portion 34 being integrally molded.

Figure 6:
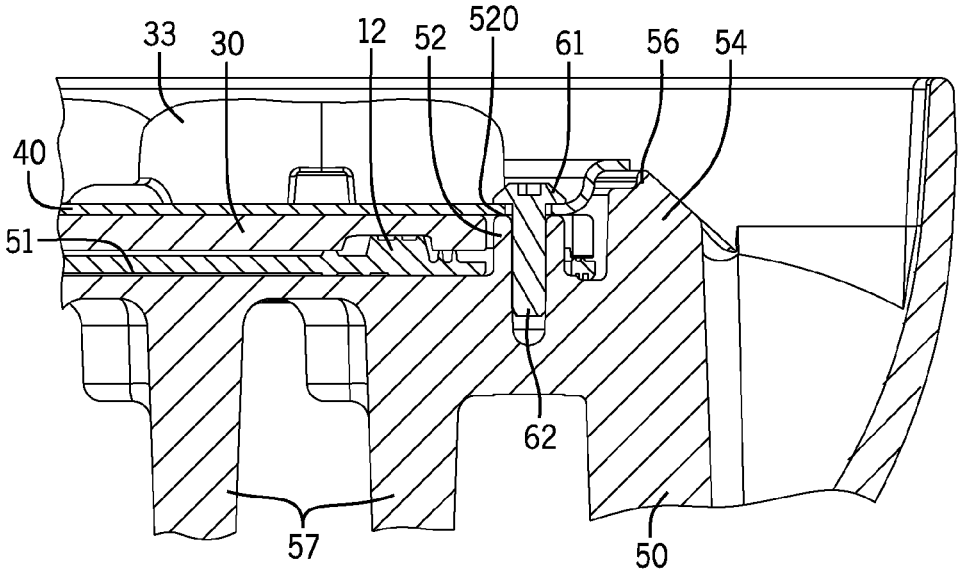
FIG. 6 is a fragmentary cross-sectional view of the LED light fixture of FIG. 1 taken along lines 6-6 seen in FIG. 3.
Figure 7:
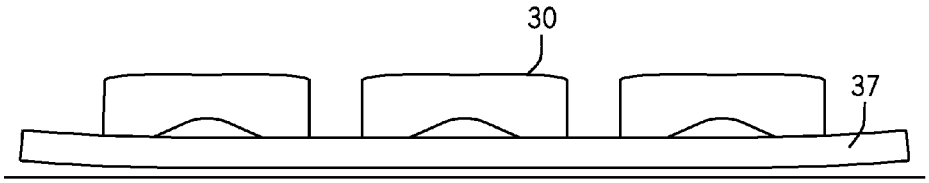
FIG. 7 is a schematic illustration of a convexity of a circuit-board-adjacent surface of the optical member.
Figure 8:
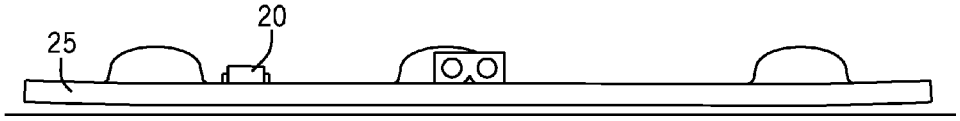
FIG. 8 is a schematic illustration of a convexity of a thermal-engagement surface of the circuit board.

FIGS. 1, 2, 5 and 6 show lighting apparatus 10 further including a heat sink 50 which is open to water/air flow. Heat sink 50 has a base 51. FIGS. 1 and 5 show circuit board 20 thermally coupled to heat-sink base 51. FIGS. 5 and 6 show rigid peripheral structure 41 of securement structure 40 engaging peripheral region 32 of optical member 30 to apply force to peripheral area 21 of circuit board 20 toward heat-sink base 51 to increase thermal coupling between circuit board 20 and heat sink 50, thereby facilitating heat transfer from the LEDs during operation.

Such application of force along the peripheral area of the circuit board tends to minimize warping of the circuit board which would result in inadequate heat-transfer contact between the circuit board and the heat sink during operation. In attempts to minimize the negative effect of warping, several intermediate materials such as thermal gel, thermal pads and screen printing on the thermal-engagement surface of the circuit board have been used between the circuit board and the heat sink. None of these methods provided sufficient thermal coupling of the circuit board to the heat sink to permit driving of LEDs to their higher capacity. It has been found that force applied by rigid peripheral structure 41 along peripheral area 21 of circuit board 20 increased thermal contact between thermal-engagement surface 25 of circuit board 20 and surface 510 of heat sink 50 which facilitated sufficient heat transfer from LEDs to allow safe LED operation at increased power levels over what was previously achieved. In fixtures utilizing single circuit board 20, the power level achieved was increased by about 100%. In fixtures where two circuit boards 20 were used side-by-side, the power level increase achieved was approximately 60%. Such substantial power level increases result in correspondingly greater light output of the fixtures without increases in number of LEDs or other changes in light sources.

FIGS. 5 and 6 show peripheral region 32 of optical member 30 extending beyond and encircling perimeter 24 of circuit board 20. FIGS. 1, 2, 5 and 6 also show lighting apparatus 10 including a gasket 12 which is sandwiched between heat sink 50 and peripheral region 32 of optical member 30. FIGS. 3-6 show rigid peripheral structure 41 of securement structure 40 pressing peripheral region 32 toward heat sink 50 with gasket 12 being compressed therebetween, thereby facilitating fluid-tight sealing around circuit board 20.

Figure 15:
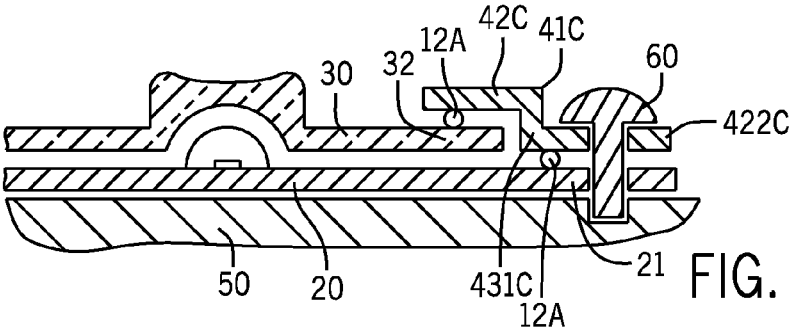
FIG. 15 is a schematic fragmentary cross-sectional view (without background) of an alternative embodiment of the LED light fixture according to the present invention.

In the alternative embodiment illustrated in FIG. 15, peripheral area 21 of circuit board 20 is beyond peripheral region 32 of optical member 30. In such embodiment, rigid peripheral structure 41C is configured to extend over circuit board 20 and over peripheral region 32 of optical member 30 and is pressed against circuit board 20 and optical member 30 by fasteners 60. It is also shown in FIG. 15 that fluid-tight sealing of middle area 23 of circuit board 20 is facilitated by gaskets 12A being compressed between rigid peripheral structure 41C and each of circuit board 20 and optical member 30.

FIGS. 1, 2 and 6 show rigid peripheral structure 41 pressed against optical member 30 by a set of fasteners 60. Each fastener 60 includes a fastener head 61 and a threaded shank 62 which extends from fastener head 61. FIG. 6 shows threaded shank 62 extending through rigid peripheral structure 41 and optical member 30 into threaded engagement with heat sink 50.

FIGS. 1 and 6 also show heat sink 50 including a set of mounting posts 52 each extending from heat-sink base 51 through peripheral region 32 of optical member 30 to a distal end 520 which is open to receive one of fasteners 60. FIG. 6 illustrates distal ends 520 of mounting posts 52 positioned such that posts 52 limit compression of rigid peripheral structure 41 against optical member 30.

Heat sink 50 is shown to further include a surrounding structure 54 extending around optical member 30 such that flange portion 34 is recessed with respect to surrounding structure 54. In FIGS. 4-6 rigid peripheral structure 41 is shown to have a pressing portion 42 which engages peripheral region 32 of optical member 30 and a stiffening portion 43 which maintains rigidity of pressing portion 42. Stiffening portion 43 is shown to have a transverse portion 431 and an outward portion 432 extending outwardly from pressing portion 42 and from circuit board 20 and engaging surrounding structure 54 of heat sink 50.

In FIG. 15, rigid peripheral structure 41C has a first pressing portion 421C engaging peripheral region 32 of optical member 30, a transverse portion 431C extending from first pressing portion 421C toward circuit board 20, and a second pressing portion 422C which extends outwardly from transverse portion 431C and engages peripheral area 21 of circuit board 20. Such non-planar configuration of rigid peripheral structure 41C with transverse portion 431C facilitates rigidity of pressing portions 421C and 422C. In the embodiment of FIG. 15, second pressing portion 422C and peripheral area 21 each define an aperture through which fastener 60 extends into a cavity defined by heat sink 20, thereby applying pressure to rigid peripheral structure 41C which presses on peripheral region 32 of optical member 30 and peripheral area 21 of circuit board 20.

Figure 14:
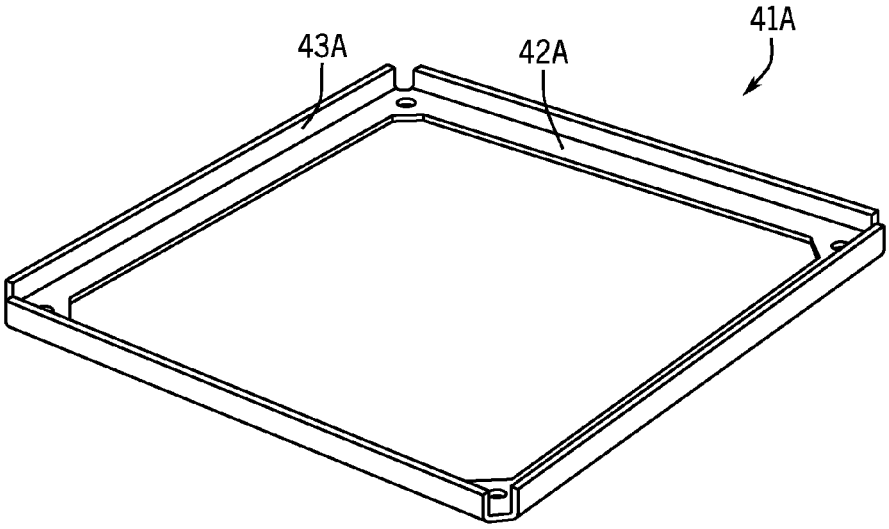
FIG. 14 is a perspective view of yet another alternative embodiment of a single-piece rigid peripheral structure.

In embodiments of FIGS. 13 and 14, rigid peripheral structures 41A and 41B have a pressing portion 42A and 42B and a stiffening portion 43A and 43B, respectively, which is in the form of a transverse portion extending substantially orthogonally to pressing portion 42A and 42B.

FIGS. 2, 5 and 6 show heat sink 50 also including heat-transfer surfaces 55 extending in a first direction away from base 51. Surrounding structure 54 is shown in the form of a peripheral ridge 56 extending from base 51 in a second direction opposite the first direction to provide additional heat-dissipating surface along heat-sink base 51. FIGS. 2, 5 and 6 show heat-transfer surfaces 55 as surfaces of a plurality of fins 57 extending away from base 51 in the first direction. FIG. 5 shows a section 58 of peripheral ridge 56 having an outward surface 59 which is a continuation of heat-transfer surface 55 of one of fins 57 which is shown as a side fin along one side of base 51.

FIG. 5 also shows a heat sink having a first positioning feature 53, circuit board 20 having a second positioning feature 22, and optical member 30 having a third positioning feature 36. Third positioning feature 36 is shown engaging first and second mating features 53 and 22. FIG. 5 further shows third positioning feature 36 as a protrusion extending from a circuit-board-adjacent surface 37 of optical member 30. FIG. 5 shows second positioning feature 53 as a cavity in heat-sink base 51 and first positioning feature 22 as an aperture through circuit board 20 which is aligned with cavity 53. FIG. 5 illustrates the protrusion of third positioning feature 36 extending through the aperture of first positioning feature 22 and into the cavity of second positioning feature 53 to accurately align lens portions 33 of optical member 30 over their corresponding light sources 11. More details of a method and structure for aligning optical member 30 over light sources 11 are disclosed in co-owned co-pending patent application Ser. No. 13/441,571, filed on Apr. 6, 2012, the entire contents of which are incorporated herein by reference.

Figure 9:
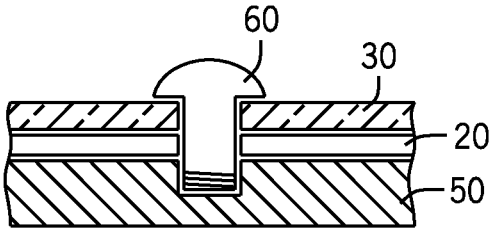
FIGS. 9-12 are schematic illustrations of alternative embodiments of features for positioning the circuit board along the heat sink and for aligning the optical member over the circuit board.

In an alternative embodiment schematically illustrated in FIG. 9, the optical member and the circuit board define aligned hollows through which a fastener such as a self-tapping screw is inserted into a cavity defined by the circuit board.

Figure 10:
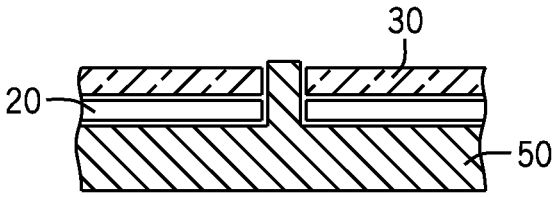

In another alternative embodiment schematically illustrated in FIG. 10, the heat sink defines a post which extends through aligned hollows defined by the circuit board and the optical member.

Figure 11:
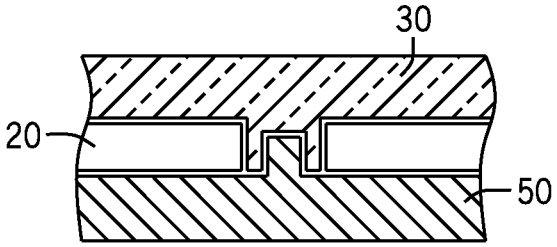

In yet another alternative embodiment schematically illustrated in FIG. 11, the optical member has a hollow post which extends through a hollow defined by the circuit board. And the heat sink has a post which extends into the hollow post of the optical member.

Figure 12:
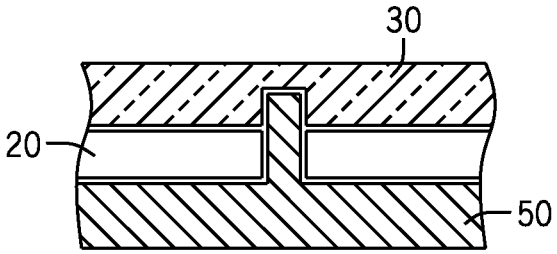

In still another alternative embodiment schematically illustrated in FIG. 12, the heat sink has a post which extends through a hollow defined by the circuit board and into a cavity defined by the optical member.

FIGS. 2 and 5 show light sources 11 as each including a primary lens 13 such that each lens portion 33 of optical member 30 is a secondary lens aligned over the respective one of primary lenses 13.

FIGS. 1-4 show each secondary lens 33 of optical member 30 configured for preferential-side distribution of light from corresponding light source 11.

In some embodiments each light source is an LED package which has one LED or an array of LEDs. A primary lens may be overmolded over the LED(s).

In fixtures of the type shown in FIGS. 1 and 2 utilizing a plurality of light sources, a plurality of LEDs or LED arrays may be disposed directly on a common submount in spaced relationship between the LEDs or LED arrays. Each of such LEDs or LED arrays may be overmolded with a respective primary lens. This type of LEDs is sometimes referred to as chip-on-board LEDs.

It should be understood that, for higher efficiency in achieving a preferential-side direction of light, LED light sources each may have a primary lens having its centerline offset from the emitter axis and/or be shaped for refraction of LED-emitted light toward a preferential side. Primary lenses may also be asymmetric. Some exemplary light sources are described in detail in patent application Ser. No. 13/441,558, filed on Apr. 6, 2012, and in patent application Ser. No. 13/441,620, filed on Apr. 6, 2012. Contents of both applications are incorporated herein by reference in their entirety.

While the principles of the invention have been shown and described in connection with specific embodiments, it is to be understood that such embodiments are by way of example and are not limiting.

The invention claimed is:

1. Lighting apparatus comprising:

a circuit board with a plurality of light sources spaced thereon;

a heat sink open to water/air flow, the circuit board being in thermal contact with the heat sink;

an optical member comprising (a) a plurality of lens portions over corresponding light sources and (b) a flange portion in contact with the circuit board and having a peripheral region extending beyond the perimeter of the circuit board and encircling an inner region between the lens portions and the circuit board; and a securement frame securing the optical member over the light sources, the securement frame applying force to the peripheral region of the optical member toward the circuit board such that the inner and peripheral regions of the optical member press the circuit board against the heat sink, the peripheral region of the optical member sandwiching a gasket against the heat sink thereby facilitating fluid-tight sealing of the circuit board.

2. The lighting apparatus of claim 1 wherein:

the optical member is one piece of a substantially rigid material; and the securement frame includes a rigid peripheral structure pressing the optical member against the circuit board.

3. The lighting apparatus of claim 2 wherein the securement frame is a one-piece frame.

4. The lighting apparatus of claim 3 wherein the one-piece frame is a drawn sheet-metal piece.

5. The lighting apparatus of claim 4 wherein the rigid peripheral structure has a pressing portion with a substantially planar pressing surface and a stiffening portion which maintains planarity of the pressing surface.

6. The lighting apparatus of claim 3 wherein the one-piece optical member is molded acrylic.

7. The lighting apparatus of claim 1 wherein the light sources include light emitting diodes (LEDs).

8. The lighting apparatus of claim 1 wherein:

the securement structure further includes a rigid peripheral frame pressing the optical member against the circuit board; and the rigid peripheral structure is pressed against the optical member by a set of fasteners each including a fastener head and a threaded shank which extends from the fastener head through the rigid peripheral structure and the optical member into threaded engagement with the heat sink.

9. The lighting apparatus of claim 8 wherein the rigid peripheral structure is a one-piece frame.

10. The lighting apparatus of claim 9 wherein the heat sink comprises:

a base forming the surface to which the circuit board is thermally coupled; and a set of mounting posts each extending from the base through the peripheral region of the optical member to a distal post-end open to receive one of the fasteners, the distal post-ends being positioned such that the posts limit compression of the rigid peripheral structure against the optical member.

11. The lighting apparatus of claim 10 wherein the rigid peripheral structure has a pressing portion with a substantially planar pressing surface and a stiffening portion which maintains planarity of the pressing surface.

12. The lighting apparatus of claim 11 wherein the heat sink comprises a surrounding structure around the optical member configured such that the peripheral region is recessed with respect to the surrounding structure.

13. The lighting apparatus of claim 12 wherein the stiffening portion of the rigid peripheral structure extends outwardly from the pressing portion and engages the surrounding structure of the heat sink.

14. The lighting apparatus of claim 13 wherein:

the heat sink has heat-transfer surfaces extending from the base in a first direction away from the circuit board; and the surrounding structure includes a peripheral ridge extending from the base in a second direction opposite the first direction to provide additional heat-dissipating surface along the base.

15. The lighting apparatus of claim 14 wherein:

the heat-transfer surfaces are surfaces of a plurality of fins extending away from the base in the first direction; and at least a section of the peripheral ridge has an outward surface which is a continuation of a heat-transfer surface of one of the fins, such fin being a side fin along one side of the base.

16. The lighting apparatus of claim 1 wherein the heat sink has a first positioning feature and the circuit board includes a second positioning feature, the first and second positioning features being configured and arranged for locating the circuit board along the heat sink.

17. The lighting apparatus of claim 16 wherein the securement frame further includes a set of screws each extending through the circuit-board middle area into threaded engagement with the heat sink.

18. The lighting apparatus of claim 16 wherein the optical member includes a third positioning feature in mating engagement with at least the second positioning feature of the circuit board to accurately align the optical member over the light sources.

19. The lighting apparatus of claim 18 wherein the first positioning feature is a cavity open at the base of the heat sink, the second positioning feature is an aperture through the circuit board, and the third positioning feature is a protrusion extending from the optical member through the aperture of the circuit board and into the cavity of the heat sink, thereby simultaneously locating the circuit board along the heat sink and accurately aligning the optical member over the light sources.

20. The lighting apparatus of claim 19 wherein the securement frame is a one-piece frame that is a drawn sheet-metal piece disposed over the peripheral region of the optical member.

21. Lighting apparatus comprising:

a circuit board with a plurality of light sources spaced thereon;

a heat sink open to water/air flow, the circuit board being in thermal contact with the heat sink;

an optical member comprising (a) a plurality of lens portions over corresponding light sources and (b) a flange portion in contact with the circuit board and having an inner region between the lens portions and a peripheral region extending beyond and encircling the perimeter of the circuit board; and a rigid peripheral frame securing the optical member over the light sources, the rigid peripheral frame applying force to the peripheral region of the optical member toward the circuit board such that the inner and peripheral regions of the optical member press the circuit board against the heat sink, the peripheral region of the optical member sandwiching a gasket against the heat sink to facilitate fluid-tight sealing of the circuit board.

22. The lighting apparatus of claim 21 wherein the optical member is one piece of a substantially rigid material.

23. The lighting apparatus of claim 22 wherein the rigid peripheral frame is a one-piece frame.

24. The lighting apparatus of claim 23 wherein the rigid peripheral frame has a pressing portion with a substantially planar pressing surface and a stiffening portion which maintains rigidity of the pressing surface.

* * * * *